US008015907B2

(12) United States Patent
Tippmann, Sr.

(10) Patent No.: US 8,015,907 B2
(45) Date of Patent: Sep. 13, 2011

(54) PROJECTILE LAUNCHER

(75) Inventor: Dennis J. Tippmann, Sr., New Haven, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 819 days.

(21) Appl. No.: 11/839,339

(22) Filed: Aug. 15, 2007

(65) Prior Publication Data

US 2008/0190275 A1 Aug. 14, 2008

Related U.S. Application Data

(63) Continuation-in-part of application No. 11/202,814, filed on Aug. 12, 2005, now Pat. No. 7,770,504.

(60) Provisional application No. 60/601,044, filed on Aug. 12, 2004.

(51) Int. Cl.
*F41A 1/04* (2006.01)
*F41B 11/00* (2006.01)

(52) U.S. Cl. ..... 89/7; 124/56

(58) Field of Classification Search ..... 89/7; 124/56, 124/74; 227/9, 10
See application file for complete search history.

(56) References Cited

U.S. PATENT DOCUMENTS

| | | | | |
|---|---|---|---|---|
| 645,932 | A | | 3/1900 | Beck et al. |
| 1,164,876 | A | | 12/1915 | Sayler |
| 1,166,837 | A | | 1/1916 | Kelly |
| 1,291,674 | A | | 1/1919 | Brannon |
| 1,359,295 | A | * | 11/1920 | Trumble ..... 89/7 |
| 1,375,653 | A | | 4/1921 | McLain et al. |
| 1,383,111 | A | * | 6/1921 | Hall et al. ..... 89/7 |
| 3,202,055 | A | | 8/1965 | Butler et al. |
| 3,255,669 | A | | 6/1966 | Olofsson |
| 3,343,455 | A | | 9/1967 | Lohr |
| 3,346,984 | A | | 10/1967 | Lohr |
| 3,728,937 | A | | 4/1973 | Nelson et al. |
| 4,043,248 | A | | 8/1977 | Bulman et al. |
| 4,109,557 | A | | 8/1978 | Zaucha |
| 4,161,133 | A | | 7/1979 | Black et al. |
| 4,365,471 | A | | 12/1982 | Adams |
| 4,377,991 | A | | 3/1983 | Liesse |
| 4,510,748 | A | | 4/1985 | Adams |
| 4,603,615 | A | * | 8/1986 | Ashley ..... 89/7 |
| 4,616,622 | A | | 10/1986 | Milliman |
| 4,665,868 | A | | 5/1987 | Adams |
| RE32,452 | E | | 7/1987 | Nikolich |
| 4,712,379 | A | | 12/1987 | Adams |
| 4,757,740 | A | * | 7/1988 | McFarland ..... 89/7 |
| 4,759,318 | A | | 7/1988 | Adams |
| 4,821,683 | A | | 4/1989 | Veldman |

(Continued)

FOREIGN PATENT DOCUMENTS

JP 60104806 6/1985

(Continued)

OTHER PUBLICATIONS

"Paintball Cannon"—Apr. 10, 2001; at http://www.geocities.com/pomanspaintball/cannon.html.

*Primary Examiner* — Bret Hayes
(74) *Attorney, Agent, or Firm* — Barnes & Thornburg LLP

(57) ABSTRACT

An apparatus for launching a projectile, such as a paintball. The apparatus uses energy generated from the combustion of fuel to propel a projectile out of the apparatus.

27 Claims, 2 Drawing Sheets

U.S. PATENT DOCUMENTS

| | | | | |
|---|---|---|---|---|
| 4,852,459 | A | 8/1989 | Bulman | |
| 4,905,634 | A | 3/1990 | Veldman | |
| 4,941,390 | A * | 7/1990 | Bulman | 89/7 |
| 4,949,621 | A | 8/1990 | Stephens | |
| 4,967,638 | A * | 11/1990 | Bulman | 89/7 |
| 5,125,320 | A | 6/1992 | Zielinski | |
| 5,199,626 | A | 4/1993 | Terayama et al. | |
| 5,257,614 | A | 11/1993 | Sullivan | |
| 5,333,594 | A | 8/1994 | Robinson | |
| 5,361,700 | A | 11/1994 | Carbone | |
| 5,377,628 | A | 1/1995 | Adams | |
| 5,462,042 | A | 10/1995 | Greenwell | |
| 5,499,567 | A | 3/1996 | Gay | |
| 5,511,333 | A | 4/1996 | Farrell | |
| 5,540,194 | A | 7/1996 | Adams | |
| 5,608,179 | A * | 3/1997 | Voecks et al. | 89/7 |
| 5,613,483 | A | 3/1997 | Lukas et al. | |
| 5,769,066 | A | 6/1998 | Schneider | |
| 5,771,621 | A | 6/1998 | Rogers | |
| 5,771,875 | A | 6/1998 | Sullivan | |
| 5,845,629 | A | 12/1998 | Ratliff | |
| D410,182 | S | 5/1999 | Etter et al. | |
| 5,967,133 | A | 10/1999 | Gardner et al. | |
| 5,988,153 | A | 11/1999 | Yoshimura | |
| 6,003,504 | A | 12/1999 | Rice et al. | |
| 6,006,704 | A | 12/1999 | Phillips et al. | |
| 6,016,945 | A | 1/2000 | Phillips et al. | |
| 6,016,946 | A | 1/2000 | Phillips et al. | |
| 6,019,072 | A | 2/2000 | Phillips et al. | |
| 6,138,656 | A | 10/2000 | Rice et al. | |
| 6,233,928 | B1 | 5/2001 | Scott | |
| 6,343,599 | B1 | 2/2002 | Perrone | |
| 6,371,099 | B1 | 4/2002 | Lee | |
| 6,418,920 | B1 | 7/2002 | Marr | |
| 6,474,326 | B1 | 11/2002 | Smith et al. | |
| 6,491,002 | B1 | 12/2002 | Adams | |
| 6,634,325 | B1 | 10/2003 | Adams | |
| 6,647,969 | B1 | 11/2003 | Adams | |
| 6,755,159 | B1 | 6/2004 | Adams et al. | |
| 7,254,914 | B2 * | 8/2007 | Lund et al. | 42/106 |
| 7,665,396 | B1 * | 2/2010 | Tippmann, Jr. | 89/7 |
| 2002/0088449 | A1 | 7/2002 | Perrone | |
| 2002/0108585 | A1 | 8/2002 | Davis | |
| 2002/0134069 | A1 | 9/2002 | Adams | |
| 2002/0134345 | A1 | 9/2002 | Adams | |
| 2002/0144498 | A1 | 10/2002 | Adams | |
| 2003/0005918 | A1 | 1/2003 | Jones | |
| 2003/0110758 | A1 | 6/2003 | Adams | |
| 2003/0131809 | A1 | 7/2003 | Adams | |
| 2004/0031382 | A1 | 2/2004 | Ogram | |
| 2004/0144012 | A1 | 7/2004 | Adams | |
| 2004/0144357 | A1 | 7/2004 | Adams | |
| 2006/0266206 | A1 * | 11/2006 | Lund et al. | 89/7 |

FOREIGN PATENT DOCUMENTS

| | | |
|---|---|---|
| JP | 4136696 | 5/1992 |
| JP | 5215492 | 8/1993 |
| JP | 6185894 | 7/1994 |

* cited by examiner

PROJECTILE LAUNCHER

RELATED APPLICATIONS

The present invention is a continuation-in-part of U.S. patent application Ser. No. 11/202,814, filed on Aug. 12, 2005, now U.S. Pat. No. 7,770,504 which claims priority to U.S. Provisional Application No. 60/601,044, filed on Aug. 12, 2004, the entire disclosures of which are hereby incorporated by reference.

TECHNICAL FIELD

The present invention relates to an apparatus for launching projectiles and particularly to an apparatus that uses the combustion of fuel to launch projectiles.

BACKGROUND

In many cases, compressed gas is used to launch projectiles. For example, paintball markers typically launch frangible projectiles, such as paintballs, by selectively releasing compressed gas. In addition to frangible projectiles, other non-lethal projectiles, such as BBs, pellets, air-soft pellets/BBs, darts, etc., are commonly launched using compressed gas, such as carbon dioxide and air.

Paintball markers are primarily used for paintball gaming. In paintball gaming, a player normally carries a paintball marker typically outfitted with a compressed gas tank and a hopper containing a supply of paintballs. It is not unusual for a player to carry an additional supply of paintballs for use, as well as extra compressed gas tanks. Currently, compressed gas tanks, such as carbon dioxide tanks, are limited to a relatively small number of shots. As paintball marker technology has developed, the firing rates of markers have increased, thereby requiring more compressed gas. Since tank size is limited, players are required to carry extras for a lengthy game session. Increasing substantially the number of shots-per-tank would reduce or eliminate the need to carry extra tanks. Such an increase would also reduce time spent on changing tanks in the field and/or on refilling tanks for subsequent use.

SUMMARY

According to one aspect, the invention provides a method for launching a paintball from a paintball marker having a combustion chamber and an ignition actuator. The first step of the method is generating a spark in the combustion chamber in response to a user actuating the ignition actuator, which ignites a combustible mixture within the combustion chamber. A piston is then moved from an initial position and combustion gases are directed toward the paintball to propel the paintball out of the paintball marker.

According to another aspect, the invention provides a paintball marker. The paintball marker may include a receiver that defines a combustion chamber and a barrel extending from the receiver. A fuel injector may be provided to selectively dispense fuel into the combustion chamber. The marker may have an igniter device that generates a spark within the combustion chamber. A piston is also provided that moves in a first direction in response to ignition in the combustion chamber. The marker also may include means for selectively releasing combustion gases from the combustion chamber to propel a paintball through the barrel. Preferably, the releasing means is operatively coupled to the piston while releasing combustion gases from the combustion chamber.

According to yet another aspect, the invention provides a method for launching a projectile from a projectile launcher. The method includes the step of initiating launching of the projectile by generating an electrical spark. The combustible mixture is ignited within a combustion chamber responsive to the electrical spark. The projectile is propelled out of the launcher by the combustion gases.

According to a still further aspect, the invention provides an apparatus for launching projectiles. The apparatus may include a receiver defining a combustion chamber and a bore. A fuel injector may be provided to selectively dispense fuel into the combustion chamber. An igniter device may be included to generate a spark within the combustion chamber. A piston is movable within the combustion chamber, such that generation of a spark by the igniter device ignites a combustible mixture in the combustion chamber to move the piston in a first direction. The apparatus may include a valve to release combustion gases from the combustion chamber to propel a projectile through the bore. Generally, the valve is at least partially disposed within the piston when the valve releases combustion gases from the combustion chamber.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF DRAWINGS

The present disclosure will be described hereafter with reference to the attached drawings which is given as a non-limiting example only, in which.

Figure 1:
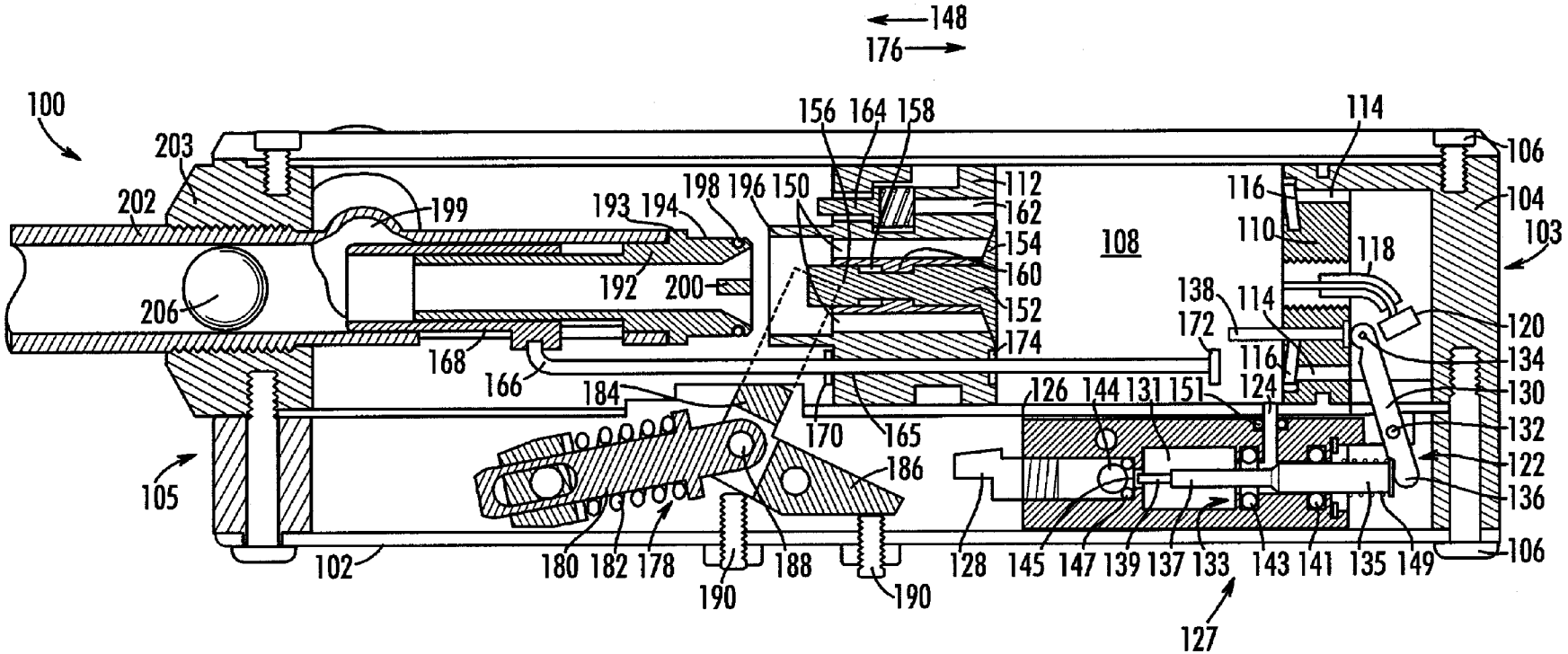
FIG. 1 is a side cross-sectional view of an apparatus for launching a projectile according to an embodiment of the invention.

Corresponding reference characters indicate corresponding parts throughout the several views. The components in the Figures are not necessarily to scale, emphasis instead being placed upon illustrating the principles of the invention. The exemplification set out herein illustrates embodiments of the invention, and such exemplification is not to be construed as limiting the scope of the invention in any manner.

DETAILED DESCRIPTION OF THE DRAWING

FIG. 1 shows an apparatus 100 for launching a projectile using energy from the combustion of fuel. The apparatus 100 preferably launches projectiles in an automatic or semi-automatic manner, without requiring the firing mechanism to be manually reset after each launch. Although the example apparatus is described as a semi-automatic launcher, the apparatus 100 could have an automatic firing mechanism. If desired, the apparatus 100 could be easily modified to require manual cocking of the firing mechanism between each shot.

The apparatus 100 may be used to launch a variety of projectiles. Typically, the apparatus 100 would be used to launch non-lethal projectiles that would be similar to those used in conjunction with compressed-gas guns, such as paint ball markers, air rifles, pellet rifles, nail guns, etc. By way of example only, the apparatus 100 may launch paintballs, BBs, pellets, air-soft pellets/BBs, darts, spark balls, pepper balls, nails, etc. In a particular application in which the apparatus 100 is a paintball marker, the apparatus 100 may be sized to launch a frangible .68 caliber paintball at approximately 300 feet per second. By way of another example, the apparatus 100 may be a nail gun that is configured to drive nails into a surface. It should be appreciated that the apparatus 100 could be manufactured in other shapes, depending upon the exigencies of a particular application.

In the example embodiment shown, the apparatus 100 includes a receiver 102 defining an internal cavity. The receiver may be a unitary member or multiple pieces that are coupled together, such the example shown. As used herein, the term "coupled" is broadly intended to encompass both direct and indirect connections.

In the example shown, the apparatus 100 includes a barrel 202 extending from the receiver 102. The barrel 202 may attach to a receiver 102, such as by screwing, interference fit, frictional fit, or unitary formation. In the example shown, the barrel includes a breech end screwed into the receiver 102. The barrel 202 includes a bore dimensioned to receive a projectile 206. In some embodiments, for example, the bore may be dimensioned to receive a .68 caliber paintball. When the apparatus 100 is fired, the projectile 206 passes through and exits out the barrel 202.

In some cases, the rear portion 103 of the receiver 102 may include an access cap 104 that provides access to internal components of the apparatus 100 for repair and/or replacement. It should be appreciated that the access cap 104 could be provided on the front portion 105 of the receiver 102 in some cases, for example, or any other portion of the receiver 102 depending on the particular circumstances. The access cap 104 could be releasably coupled to the receiver 102 using one or more fasteners 106, such as bolts, clasps, latches, clips, bayonet connections, etc.

In the embodiment shown, a combustion chamber 108 is defined within the receiver 102 between a wall 110 and a piston 112. As shown, the wall 110 defines one or more air intake holes 114 adapted to allow flow of air into the combustion chamber 108. A one-way valve 116, such as a flapper valve, controls flow through the air intake holes 114. The one-way valve 116 prevents flow from the combustion chamber 108 out through the air intake holes 114; however, the one-way valve 116 allows flow into the combustion chamber 108 through the air intake holes 114.

As shown, the apparatus 100 includes an igniter device 118 adapted to generate a spark in the combustion chamber 108. In some embodiments, the igniter device 118 may be a spark plug. Embodiments are also contemplated in which the igniter device 118 may be a piezoelectric device. Other devices adapted to generate a spark may also be used.

Preferably, the igniter device 118 generates a spark in the combustion chamber 108 to initiate launching of a projectile. In other words, the spark generated by the igniter device 118 sets into motion the remaining events that cause the projectile to be propelled out of the barrel 202. For example, the igniter device 118 preferably generates a spark prior to any movement of the piston 112. Typically, the launching of the projectile 206 is initiated by having the igniter device 118 generate an electrical signal to produce a spark. If the igniter device 118 were a piezoelectric device, for example, the piezoelectric device may generate an electrical spark responsive to actuating a trigger. By way of another example, if the igniter device 118 were a spark plug, the spark plug may produce an electrical spark responsive to pushing a button. The ignition actuator 120 may actuate the igniter device 118 electronically or mechanically. For example, the ignition actuator 120 may be a trigger, push button, slide switch, or other mechanism capable of actuating the igniter device 118.

As shown, the apparatus 100 includes a fuel injector 122 adapted to selectively dispense fuel into the combustion chamber 108. The term "fuel" is broadly intended to encompass any ignitable fluid, whether in a liquid or gaseous state. The fuel may include, but is not limited to, liquified petroleum ("LP") gas, natural gas, gasoline, propane, butane, isobutene, methylacetylene-propadiene ("MAPP"), or acetylene. For example, readily available propane canisters could be used with the apparatus 100.

In the example shown, a fuel injection port 124 is defined in a side wall 126 of the combustion chamber 108. A fuel metering assembly 127 calibrates the volume of fuel dispensed into the combustion chamber 108 from a source of fuel 128. In the embodiment shown, the fuel metering assembly 127 includes a calibrated fuel reservoir 131 with a predetermined volume. As shown, the fuel metering assembly 127 includes a valve stem 133 with an enlarged portion 135, a reduced portion 137, and a tip 139. The example shows the fuel metering assembly 127 with a first seal 141, a second seal 143 and a third seal 147.

With the valve stem 133 in the position shown in FIG. 1, a ball 144 blocks flow of fuel through a fuel supply port 145. When actuated, the valve stem 133 moves in the direction of arrow 148. This movement has two consequences in the embodiment shown: (1) the tip 139 moves the ball 144 from sealing engagement with the third seal 147, which allows flow through the fuel supply port 145; and (2) the enlarged portion 135 moves into sealing engagement with the second seal 143, which blocks flow through the fuel injection port 124. The tip 139 is preferably dimensioned smaller than the fuel supply port 145, which allows flow of fuel into the calibrated fuel reservoir 131.

When the valve stem 133 returns to the position shown in FIG. 1, as discussed below, the enlarged portion 135 no longer blocks flow through the fuel injection port 124 and the ball 144 returns to block flow through the fuel supply port 145. The reduced portion 137 is preferably dimensioned to allow flow from the calibrated fuel reservoir 131 through the fuel injection port 124 and into the combustion chamber 108. Accordingly, the fuel within the calibrated fuel reservoir 131 flows through the fuel injection port 124 into the combustion chamber 108. A seal 151 may be provided to prevent flow between the fuel metering assembly 127 and the wall 126. Embodiments are contemplated in which the fuel metering assembly 127 could include electronically controlled valves or sensors within the receiver 102 to calibrate the amount of fuel dispensed into the combustion chamber 108. For example, the piston 112 could include a magnetic portion that trips a magnetically actuated switch, such as a Hall-effect switch, to control the metering of fuel. By way of another example, an electronic eye could be used to control metering of fuel.

Various mechanisms could be used to actuate the fuel metering assembly 127. In the example embodiment shown, the fuel injector y includes a lever 130 pivotally connected on a pivot point 132. The lever 130 includes a first end 134 and a second end 136. A pin 138 slidably disposed in the wall 110 engages the first end 134 of the lever 130 to cause rotation about the pivot point 132. The rotation of the lever 130 causes the second end 136 to engage the enlarged portion 135 of the valve stem 133. This causes the valve stem 133 to move in the direction of arrow 148, thereby filling the calibrated fuel reservoir 131 with fuel. A biasing member 149 may be provided to return the lever 130 to the position shown in FIG. 1.

The ignition of an air/fuel mixture within the combustion chamber 108 propels the piston 112 in the direction of arrow 148. In the embodiment shown, the piston 112 defines one or more passageways 150 therethrough. The passageways 150 allow flow of combustion gases through the piston 112.

A valve 152 may be provided to control flow through the passageways 150. In the example shown, the valve 152 is disposed within the piston 112. The valve 152 includes a sealing end 154 adapted to selectively limit flow through the passageways 150. In the position shown in FIG. 1, the sealing end 154 of the valve 152 blocks the flow through the piston 112. The valve 152 may also move to a position that allows flow through the passageways 150. In the embodiment shown, the valve 152 includes a front portion 156 with flanges 158 configured to engage stop 160 to limit movement of the valve 152 within the piston 112.

In the embodiment shown, the piston 112 includes a priming passageway 162 that may be selectively opened/closed with a primer valve 164. Preferably, the primer valve may be manually actuated to vent the combustion chamber 108 and allow movement of the piston 112 with respect to the receiver 102. For example, a cocking handle could be used to actuate the primer valve.

In the embodiment shown, the piston 112 defines an opening 165 dimensioned to slidably receive a link 166. A bolt 168 is coupled to the link 166 such that movement of the link 166 causes concomitant movement of the bolt 168. In the embodiment shown, the link 166 includes a front flange 170. When the piston 112 moves in the direction of arrow 148, the piston 112 may engage the flange 170 to move the link 166, thereby moving the bolt 168 in the direction of arrow 148. The link 166 may also include a rear flange 172 adapted to be received in a recess 174 formed in the piston 112. Accordingly, movement of the piston in the direction of arrow 176 may cause the piston 112 to engage the rear flange 172 of the link 166, thereby moving the bolt 168 in the direction of the arrow 176.

For the piston 112 to move in the direction of arrow 148, the piston 112 must overcome the urging of a biasing member 178. In the example shown, the biasing member 178 includes a base 180 with a spring 182, a first leg 184 adjacent the piston 112, and a second leg 186 adjacent to the receiver 102. In the example shown, the first leg 184 and the second leg 186 pivot about a pivot point 188. In some embodiments, the biasing member 178 may be associated with adjustment mechanisms 190 adapted to vary the position of the biasing member 178, which may adjust the position of the piston 112 and urging of the biasing member 178.

In the embodiment shown, the apparatus 100 includes an outlet member 192 defining an outlet path for combustion gases. As shown, the bolt 168 is slidably received on the outlet member 192. A flange 193 may be provided to limit movement of the bolt 168 with respect to the outlet member 192. In some cases, the outlet member 192 may include a sealing wall 194 dimensioned to receive a sidewall 196 of the piston 112. A seal 198 is provided to prevent flow between the sealing wall 194 and the sidewall 196. In some cases, a projectile inlet port 199 may be defined between (or in) the barrel 202 and the outlet member 192.

As shown in the example embodiment, a valve engaging member 200 may be provided to open the valve 152. For example, the valve engaging member may be in the path of the valve 152 as the piston 112 moves in the direction of arrow 148. By impacting the front portion 156 of the valve 152 as the piston 112 moves in the direction of arrow 148, the valve 152 allows fluid flow through the passages 150.

A cycle of the apparatus 100 will now be described. In the event that an air/fuel mixture is not within the combustion chamber 108 or has dissipated within the combustion chamber 108, the apparatus 100 may be primed. To prime the apparatus 100, the primer valve 164 may be manually actuated to vent the combustion chamber 108 (such as a cocking handle), which allows the piston to be moved in the direction of arrow 176. The piston 112 may then be moved in the direction of arrow 176 until the piston contacts the wall 110. This will cause the piston 112 to move the pin 138 in the direction of arrow 176, thereby rotating the lever 130 to dispense fuel into the calibrated fuel reservoir 131. A biasing member (not shown) may be provided within the combustion chamber 108 (or other area of the apparatus 100) to urge the piston 112 in the direction of arrow 148 until the piston 112 contacts the first leg 184 of the biasing member 178. When the piston 112 moves in the direction of arrow 148, the pin 138 returns to the position shown in FIG. 1, which allows fuel to be dispensed into the combustion chamber 108 from the calibrated fuel reservoir 131. Air will also be drawn through the air intake holes 114, thereby providing an air/fuel mixture within the combustion chamber 108.

The user may actuate the ignition actuator 120, such as a trigger, which causes the igniter device 118 to generate a spark. The spark ignites the air/fuel mixture within the combustion chamber 108, thereby causing the piston 112 to overcome the urging of biasing member 178 and be propelled in the direction of the arrow 148.

The movement of the piston in the direction 148 causes the piston 112 to engage the flange 170 on the link 166, thereby moving the bolt 168 in the direction of arrow 148. This action moves a projectile 206, such as a paintball, into a launching position in the breech end of the barrel 202.

The piston 112 continues movement toward the outlet member 192 until the valve engaging member 200 impacts the front portion 156 of the valve 152. This moves the valve 152 to an open position, which allows flow of combustion gases from the combustion chamber 108 through the passageways 150 in the piston 112. The sealing wall 194 of the outlet member 192 receives the sidewall 196 of the piston 112, thereby preventing fluid flow escape within the interior of the receiver 102. The flow of combustion gases through the passageways 150 and outlet member 192 propels the projectile out of the barrel 202.

When the pressure within the combustion chamber 108 decreases sufficiently due to combustion gases exiting through the barrel 202, the biasing member 178 propels the piston 112 in the direction of arrow 176. As the piston 112 moves in the direction of arrow 176, the piston 112 engages the rear flange 172 of the link 166, which moves the bolt 168 rearward, thereby allowing another projectile 206 to enter the projectile inlet port 199 of the apparatus 100. Since the valve 152 is open as the piston 112 moves in the direction of arrow 176, combustion gases flow through the passageways 150 in the piston 152. When the piston 152 contacts the wall 110, however, this closes the valve 152 due to contact of the wall 110 with the sealing end 154 of the valve 152.

The piston 112 also contacts the pin 138, thereby rotating the lever 130 to actuate the fuel metering assembly 127, which dispenses fuel into the calibrated fuel reservoir 131. A biasing member (not shown) may be disposed between the front cap 203 and piston (or another position) to urge the piston 112 in the direction of arrow 148 toward the first leg 184 of the biasing member 178. This movement of the piston 112 releases the pin 138 to allow the fuel metering assembly 127 to dispense fuel into the combustion chamber 108. The movement of the piston 112 toward the first leg 184 also draws air into the combustion chamber 108 through the air intake holes 114. Accordingly, the apparatus 100 is ready to launch another projectile.

Figure 2:
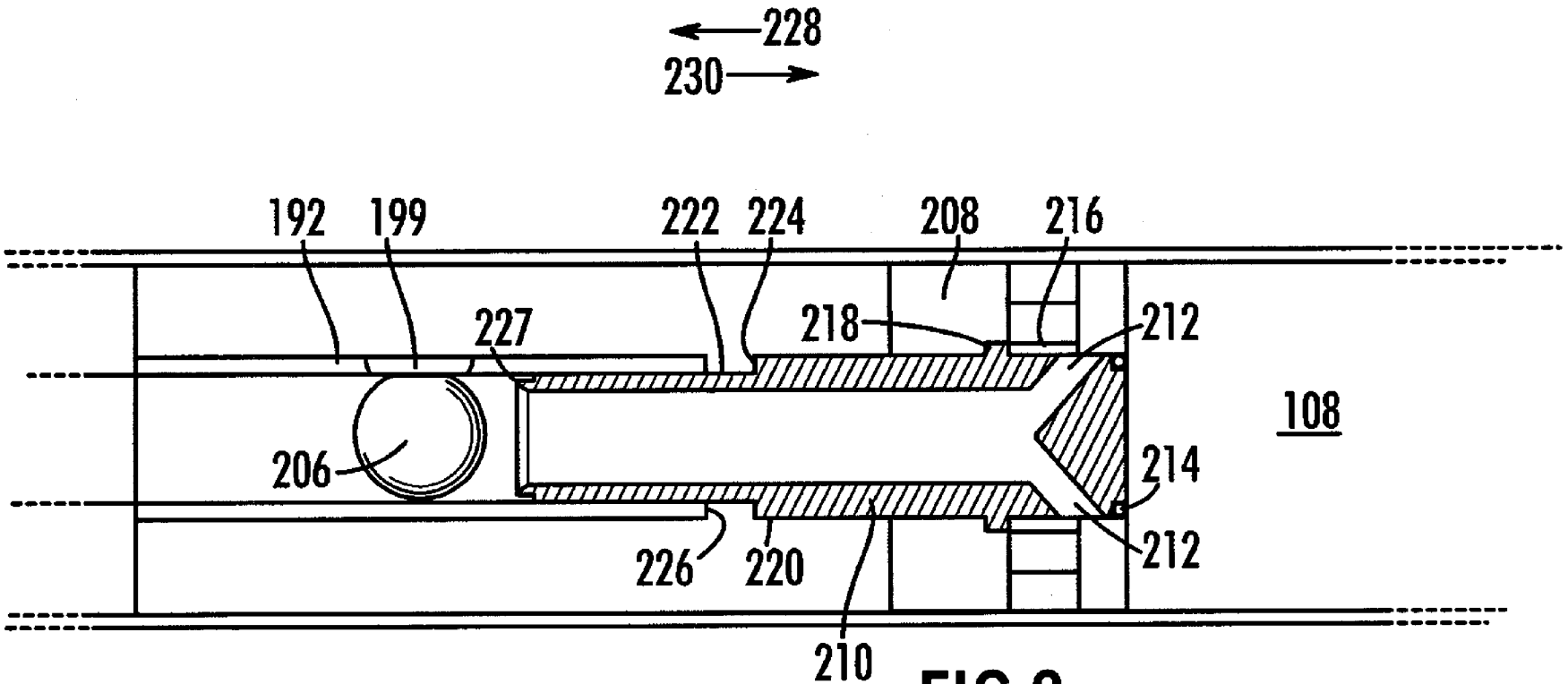
FIG. 2 is an alternative embodiment that combines the valve and front bolt.

FIG. 2 shows an alternative embodiment in which the bolt 168 and the valve 152 are combined into a single structure.

The configuration shown in this embodiment eliminates the link 166, as well as the valve engaging member 200. The other components in the apparatus 100 work similarly to that previously described above with respect to FIG. 1.

In this embodiment, a piston 208 slidably receives a valve 210. As shown, the valve 210 is in a closed position in which the piston 208 blocks one or more passageways 212 through the valve 210. In the closed position, the piston 208 and seal 214 prevent fluid communication between the combustion chamber 108 and the projectile 206. As discussed below, the valve 210 opens thereby providing fluid communication between the combustion chamber 108 and the projectile 206 when the piston 208 moves with respect to the valve 210 to expose the passageways 212 to the combustion chamber 108. A mechanism may be provided to limit movement of the piston 208 with respect to the valve 210. In this example, the piston 208 includes a groove 216 that receives a ridge 218 on an exterior surface of the valve 210. The ridge 218 limits movement of the piston 208 with respect to the valve 210.

As shown, the valve 210 includes a first wall 220 dimensioned to be received by the piston 208 and a second wall 222 dimensioned to be received by the outlet member 192 (or barrel 202 in some embodiments). The transition between the first wall 220 and the second wall 222 defines a flange 224 that is configured to impact the end 226 of the outlet member 192 when the piston 208 and valve 210 move in the direction of arrow 228 due to combustion gases within the combustion chamber 108. The impact between the flange 224 and the end 226 of the outlet member 192 moves the valve 210 to an open position due to the movement of the piston 208 in the direction of arrow 228 with respect to the valve 210, thereby providing fluid communication between the combustion chamber 108 and the projectile 206. This causes combustion gases to flow through the passageways 212 in the valve 210 and propel the projectile 206 out of the barrel 202.

The leading end 227 of the valve is configured to engage the projectile 206, similarly to the function of the bolt 168 in the embodiment shown in FIG. 1. Accordingly, the movement of the valve 210 in the direction of arrow 228 also engages the projectile 206 and seals the projectile inlet port 199 so that the projectile is in a firing position and the combustion gases do not flow through the port 199.

When the pressure in the combustion chamber 108 decreases sufficiently due to combustion gases exiting through the barrel 202, the biasing member 178 propels the piston 208 in the direction of arrow 230. As the piston 208 moves in the direction of arrow 230, the second wall 222 allows entry of another projectile through the projectile inlet port 199. Since the valve 210 is open as the piston 208 moves in the direction of arrow 230, combustion gases flow through the passageways 212 in the valve 210. A mechanism could be provided to maintain the relative positions of the piston 208 and the valve 210 as the piston travels in the direction of arrow 230 to maintain an open position of the valve 210. When the piston 208 contacts the wall 110, however, this closes the passageways 212 due to movement of the piston 208 returning to the closed position shown in FIG. 2. A biasing member (not shown) may be provided to move the piston 208 in the direction of arrow 228 back to the initial position.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A method for launching a projectile from a projectile launcher, the method comprising the steps of:

initiating launching of the projectile by generating an electrical spark;

igniting a combustible mixture of air and fuel within a combustion chamber responsive to the electrical spark;

moving the projectile to a launching position responsive to movement of a bolt from an initial position;

directing combustion gases toward the projectile to propel the projectile out of the projectile launcher;

returning the bolt to the initial position;

forming a combustible mixture for a subsequent launch by drawing air through one or more air intake holes into the combustion chamber and injecting fuel into the combustion chamber; and wherein the bolt moves from the initial position responsive to ignition in the combustion chamber.

2. The method of claim 1, further comprising the step of moving a piston in a first direction responsive to ignition within the combustion chamber.

3. The method of claim 2, further comprising the step of moving the piston in a second direction when pressure within the combustion chamber falls below a predetermined pressure.

4. The method of claim 3, wherein the piston moves substantially through the entire combustion chamber when moving in the second direction.

5. The method of claim 3, further comprising the step of actuating a fuel injector responsive to the piston reaching a second position, wherein the fuel injector dispenses a quantity of fuel into the combustion chamber.

6. The method of claim 5, further comprising the step of moving a bolt between a third position to engage the projectile and a fourth position, wherein the piston drives the bolt toward the third position while moving in the first direction.

7. The method of claim 6, wherein the piston drives the bolt toward the fourth position while moving in the second direction.

8. The method of claim 1, wherein the combustion chamber defines the air intake holes.

9. A method of launching a projectile from a projectile launcher, the method comprising the steps of:

initiating launching of the projectile by generating an electrical spark;

igniting a combustible mixture within a combustion chamber responsive to the electrical spark;

moving a piston in a first direction responsive to ignition within the combustion chamber;

moving the projectile to a launching position responsive to movement of a bolt from an initial position;

directing combustion gases toward the projectile to propel the projectile out of the projectile launcher;

returning the bolt to the initial position;

wherein the bolt moves from the initial position responsive to ignition in the combustion chamber; and wherein the piston includes at least one passageway for directing combustion gases to the projectile.

10. The method of claim 9, further comprising the step of opening a valve associated with the passageway when the piston reaches a first position.

11. The method of claim 10, further comprising the step of closing the valve when the piston reaches a second position.

12. The method of claim 11, wherein the valve is at least partially disposed within the piston.

13. The method of claim 9, further comprising the step of moving the piston in a second direction when pressure within the combustion chamber falls below a predetermined pressure.

14. The method of claim 13, wherein the piston moves substantially through the entire combustion chamber when moving in the second direction.

15. The method of claim 13, further comprising the step of actuating a fuel injector responsive to the piston reaching a second position, wherein the fuel injector dispenses a quantity of fuel into the combustion chamber.

16. The method of claim 15, wherein the fuel injector includes a valve stem and wherein the valve stem moves substantially in an opposite direction with respect to the second direction when moving to an open position.

17. The method of claim 16, wherein the valve stem moves in an approximately parallel direction with respect to movement of the piston.

18. The method of claim 16, wherein the valve stem is laterally offset from the piston.

19. The method of claim 16, further comprising the step of moving a bolt between a third position to engage the projectile and a fourth position, wherein the piston drives the bolt toward the third position while moving in the first direction.

20. The method of claim 19, wherein the piston drives the bolt toward the fourth position while moving in the second direction.

21. A method of launching a projectile from a projectile launcher, the method comprising the steps of:

initiating launching of the projectile by generating an electrical spark;

igniting a combustible mixture within a combustion chamber responsive to the electrical spark;

moving a piston in a first direction responsive to ignition within the combustion chamber;

moving the projectile to a launching position responsive to movement of a bolt from an initial position;

directing combustion gases toward the projectile to propel the projectile out of the projectile launcher;

moving the piston in a second direction when pressure within the combustion chamber falls below a predetermined pressure;

actuating a fuel injector responsive to the piston reaching a second position, wherein the fuel injector dispenses a quantity of fuel into the combustion chamber;

returning the bolt to the initial position;

wherein the bolt moves from the initial position responsive to ignition in the combustion chamber; and wherein the fuel injector includes a valve stem and wherein the valve stem moves substantially in an opposite direction with respect to the second direction when moving to an open position.

22. The method of claim 21, wherein the valve stem moves in an approximately parallel direction with respect to movement of the piston.

23. The method of claim 22, wherein the valve stem is laterally offset from the piston.

24. The method of claim 21, wherein the fuel injector includes a valve stem and wherein the valve stem moves substantially in an opposite direction with respect to the second direction when moving to an open position.

25. The method of claim 24, further comprising the step of opening a valve associated with the passageway when the piston reaches a first position.

26. The method of claim 25, further comprising the step of closing the valve when the piston reaches a second position.

27. The method of claim 26, wherein the valve is at least partially disposed within the piston.

* * * * *